United States Patent [19]

Ogawa

[11] 4,090,321

[45] May 23, 1978

[54] ANIMATED RECONFIGURABLE COMMAND STATION TOY

[75] Inventor: Iwakichi Ogawa, Kashiwa, Japan

[73] Assignee: Takara Co., Ltd., Tokyo, Japan

[21] Appl. No.: 694,192

[22] Filed: Jun. 9, 1976

[51] Int. Cl.[2] ..... A63H 33/42

[52] U.S. Cl. ..... 46/12; 46/145

[58] Field of Search ..... 46/17, 145, 146, 1 R, 46/12

[56] References Cited

U.S. PATENT DOCUMENTS

| | | | |
|---|---|---|---|
| 1,641,209 | 9/1927 | Wallace | 46/12 |
| 2,872,753 | 2/1959 | Fenton | 46/12 |
| 3,841,018 | 10/1974 | Reiling | 46/12 |

FOREIGN PATENT DOCUMENTS

| | | | |
|---|---|---|---|
| 938,171 | 1/1956 | Germany | 46/12 |

*Primary Examiner*—F. Barry Shay

*Attorney, Agent, or Firm*—Harold L. Jackson; Stanley R. Jones; Joseph W. Price

[57] ABSTRACT

A space command toy station is provided including a pair of parallel substantially hexagonal frame members. Extending between the hexagonal frame members are front and rear planar surface members. The rear planar surface member is pivotally mounted and includes an observation platform displaced outwardly at an angle therefrom. The rear planar surface when rotated, closes its original space and causes the observation platform to close a space along the top between said frame members. A front platform member is mounted by a press-fit attachable pivot arm and is movable to extend from the frame of the space command station or to form a wall thereof. The toy also includes a pair of manually rotatable seats and a spring actuated ejection seat.

10 Claims, 2 Drawing Figures

ANIMATED RECONFIGURABLE COMMAND STATION TOY

BACKGROUND OF THE INVENTION

1. Field of the Invention

The subject invention relates to toys and more particularly to a toy whose parts may be assembled, disassembled and re-oriented to form a variety of configurations. The possible geometric shapes and configurations are such that envisioning them heightens the sense of perspective and perception of abstract space.

2. Description of the Prior Art

While stationary toys resembling space stations are known in the prior art, the prior art has not provided such a toy with the features of a number of functional moving parts. Nor has the prior art suggested such a toy with parts connectible at various locations to provide animation and a puzzle-like challenge, thus heightening the interest in the toy and the education provided thereby.

SUMMARY OF THE INVENTION

It is an object of the invention to provide a toy having a number of parts having geometric shapes which may be combined to form an object such as a space station or a number of other interesting, futuristically shaped toys. Other objects of the invention include easy assembly of the parts of the toy once configurations are envisioned, and toy structure which is relatively simple to manufacture.

These and other objects of the invention are accomplished by providing a base member comprising two substantially identically shaped frame members disposed in parallel with one another. The frame members may have a number of surface members connecting corresponding parallel sides to form a partial enclosure. A rear planar surface member may be pivotably attached between corresponding points on each frame member and may have a platform projecting outwardly therefrom, which, when rotated about the pivot point forms a wall between the parallel frame members. A third such enclosing surface may be connected by pivotable, press-fit mounting means, allowing the platform member to be moved in and out of an enclosing position with the parallel frame members. Suitable press-fit apertures may be provided on the various surfaces of the frame members to allow attachment of pods, seats and other accessories for further configuring the enclosed frame member assembly as a space station. One such accessory may be a spring-loaded, manually triggerable ejection seat.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DETAILED DESCRIPTION OF THE PREFERRED EMBODIMENT

The following description is provided to enable any person skilled in the toy industry to make and use the invention and it sets forth the best modes contemplated by the inventor of carrying out this invention. Various modifications, however, will remain readily apparent to those skilled in the above art, since the generic principals of the present invention are applied herein specifically to provide a relatively economical and easily manufactured mobile reconfigurable space command station.

Figure 1:
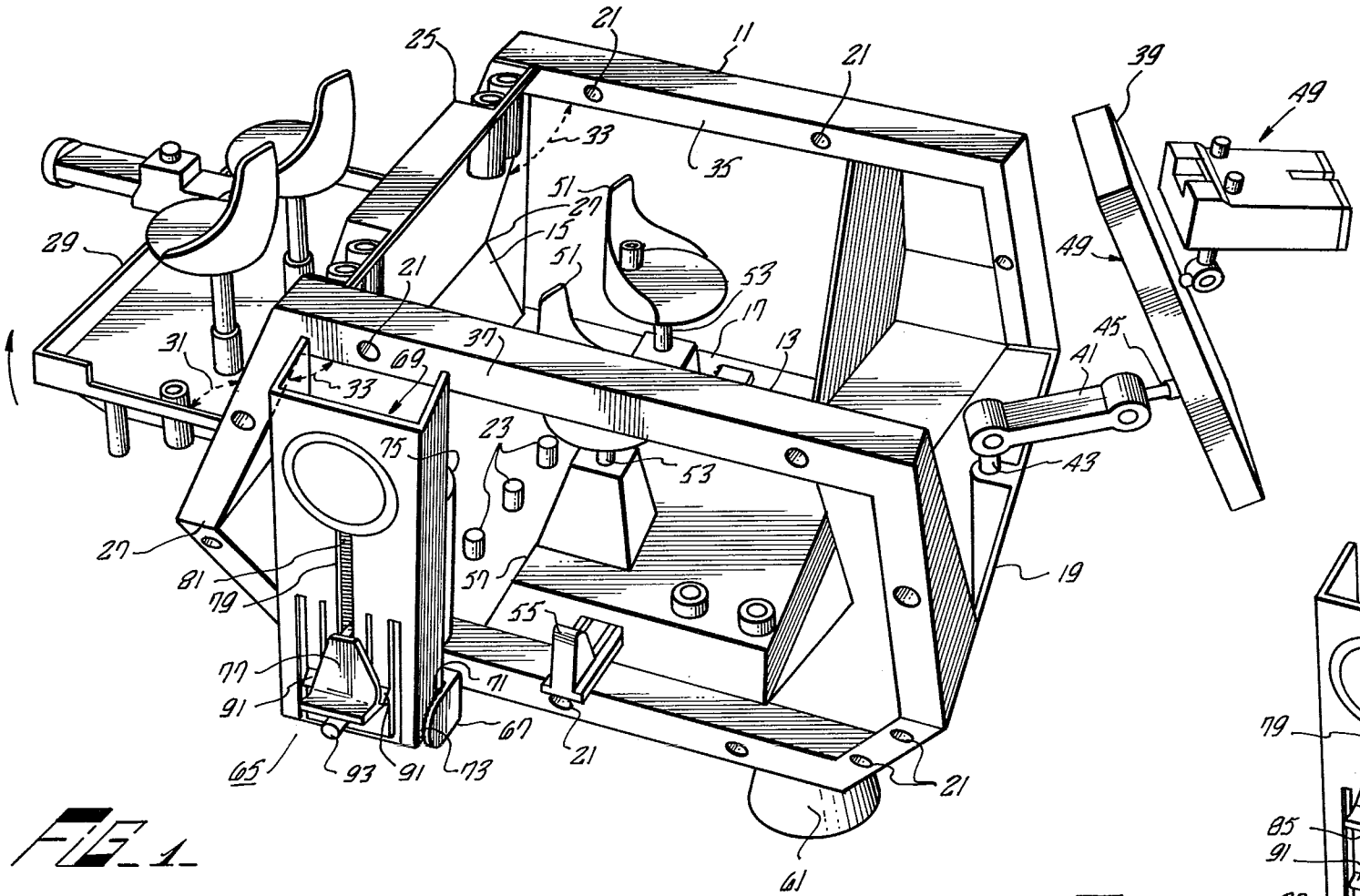
FIG. 1 is a perspective view illustrating the preferred embodiment of the invention.

As shown in FIG. 1, the preferred embodiment of the invention includes two parallel disposed, substantially hexagonal frame members 11, 13. These members are held in parallel position by respective lower planar surface members 15, 17, 19, which may be formed as a unitary member and attached by means of screws to the frame members 11, 13. Planar member 17 forms the floor of the space station while planar member 15 forms a lower rear wall and planar member 19 forms a lower front wall. As shown, the frame members 11, 13 and various closing planar surface members may be equipped with suitably disposed press-fit apertures 21 and press-fit plugs 23. In general, the press-fit apertures in the preferred embodiment are identical as are the press-fit plugs thereby providing maximum interchangeability and flexibility in configurations.

An upper wall assembly or rear pivotable planar surface member 25 extends between the upper sides of the hexagon ~~formed~~ by frame members 11, 13. This upper rear member 25 is pivotally mounted about an axis extending between the midpoints of its sides, and its bottom edge terminates at the vertices 27 of the respective hexagonal frame members 11, 13. Attached to and extending from the pivotable planar surface member 25 is a first platform or cockpit member 29 supporting seats. The angle 31 between the cockpit member 29 and the pivotable planar surface member 25 is made equivalent to the angle 33 between the respective hexagonal frame members 11, 13.

This structure provides an intriguing animational function. When the rear planar surface member 25 is rotated about its pivotal axis, at the pivot point halfway between the vertices 27 and the top of the upper bars 35, 37, which is the midpoint of its sides, the cockpit member 29 aligns in parallel with and between the upper bars 35, 37 of the respective frame members 11, 13. At the same time, the planar surface member 25 again closes the space it previously occupied between the hexagonal frame members 11, 13. Thus, the platform 29 may be rotated in and out of a "ready for action" state and a position closing the top space between upper bars 35, 37 along a portion of their length. In this, regard, it may be noted that the platform could be made other than planar in shape to conform to an upper structure other than the preferred hexagonal one.

Another interesting animational feature may be provided by a detachable front platform member, which may be moved in and out of a closing relation with the toy frame members. Such a member is illustrated in FIG. 1 where the area between the parallel frame members 11, 13 may be closed by a upper platform member 39. This platform member 39 is mounted on an arm 41 pivotally connected to two identically shaped press-fit plugs 43, 45, which fit in appropriate press-fit apertures in the planar members 19, 39.

By means of this pivoting arm 41, the platform member 39 may be maneuvered into a position between the hexagonal frame members and closing the space therebetween or may otherwise assume various positions away from the cabin space defined by the parallel frame members 11, 13. The platform member 39 may be turned completely around such that a space gun 49 may be stowed within the interior of the frame members 11, 13 or positioned outside thereof as shown in FIG. 1. This function compliments the "ready for action" concept provided by the pivotable rear platform 29.

Within the cabin area defined by the planar surface members and parallel frame members 11, 13 another animational feature is provided in the form of two seats 51, which are press-fitted onto rotating shafts 53. These shafts 53 may be manually rotated by means of a toothed bar 55, which extends into a seat mounting plate 57 attached to the planar floor surface member 17 by screws or other means. The bar 55 slides in a channel and its teeth turn a gear to rotate one of the shafts 53. In the preferred embodiment, the seats are adapted to receive toy doll figures.

Additionally, an ejection mechanism device 65 may be attached to a frame member such as 13 to provide still another animational activity. Such attachment may be made by means of a plug formed as part of a mounting bracket 67 and press-fitted into one of the apertures 21.

The chute frame 69 of the ejection mechanism 65 is attached pivotally to the bracket 67. A number of raised portions 71 on the side of the chute frame 69 permit it to be positioned at various angles by means of their contact with one of a number of projecting points 73 circularly disposed on the surface of the bracket 67. By applying a small force, the chute frame 69 may be placed at a new angle as the projecting points 73 snap over the retaining raised portions 71.

A hollow ejection capsule 75 is slideably mounted in the rear of chute frame 69 by means of a press-fit connection to a hammer 77 on the front of chute frame 69. The hammer 77 slides in a channel 79 in the chute frame 69 and is connected to stress a spring 81 attached at the top of the channel 79.

Figure 2:
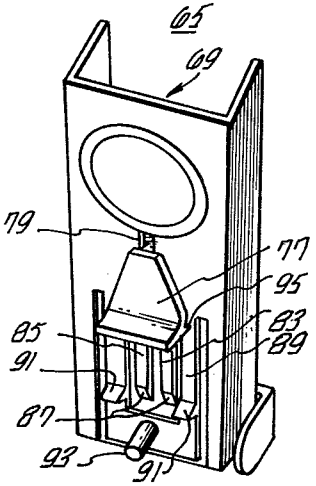
FIG. 2 illustrates in detail the ejection mechanism of the ejection seat depicted in FIG. 1.

As best illustrated in FIG. 2, the lower end of the chute 69 contains a number of cutout portions to enable cocking of the hammer 77 and then releasing it. The channel 79 ends in two flexible fingers 83, 85 having bevelled ends 87. Attached adjacent the fingers 83, 85 is a U-shaped member 89 surrounding the fingers 83, 85 and having raised ramps 91 thereon and a trigger projection 93. The fingers 83, 85 are constructed of a thickness such as to be relatively rigid, and the U-shaped member 89 is constructed to be thin and flexible for relative movement.

In order to eject material or a toy doll figure placed in the rear ejector capsule 75, the hammer 77 is pulled back to the spring 79. The hammer 77 slides down the channel formed by the fingers 83, 85 and proceeds up over the ramps 91 forcing the U-shaped member 89 rearward until the back surface of the hammer 77 slides over the ramps such that the edges 95 of the hammer are held into position by the back of the ramps 91. When it is desired to eject, the trigger 93 is depressed removing the abuttment between the back edges of the ramps 91 and the front edges 95 of the hammer 77, thereby releasing the hammer and allowing the spring force to act upon the attached ejection capsule 75.

Many other press-fit attachments may be made to the preferred embodiment. For example, conical pods 61 may be attached at the exterior four corners of the floor planar surface member 17 to add to the space station effect.

As may be seen, the just described preferred embodiment is subject to enumerable configurations and attachment of various accessories thereto. Many modifications and alterations may be made in the preferred embodiment without departing from the scope of the invention. For example, the hexagonal shape of the frame members and corresponding closing surfaces might be varied. Therefore, it is to be understood that, within the scope of the appended claims, the invention may be practiced other than as specifically described above.

What is claimed is:

1. A toy space station assembly comprising;
a base floor member;
a pair of side frame members extending upward from said floor member;
at least one lower wall member extending between said side frame members adjacent said base floor member; and
an upper wall assembly, pivotally mounted at an axis, through the midpoints of its sides to each side frame member and positioned above said lower wall member, having a first platform member connected to and extending from said upper wall assembly, said first platform member being relatively disposed to said upper wall assembly so as to permit the lower surface of said first platform member to extend across the top surface area between the side frame members when the upper wall assembly is rotated about an axis.

2. The invention of claim 1 wherein said side frame members have a hexagonal configuration and said lower wall member extends upward and outward from one side of said base floor member.

3. The invention of claim 1 further including;
a seat mounting plate assembly positioned on said base floor member;
at least one seat mounted on said plate assembly, and
means for manually driving said seat from a single position outside the area defined by and within said side frame members.

4. The invention of claim 1 further including a spring biased hammer member relatively movably mounted on one of said side frame members and means for releasing the hammer member for relative movement.

5. The invention of claim 1 further including at least one seat member mounted on said first platform member.

6. The invention of claim 1 further including a second lower wall member extending between said side frame members and extending upward and outward from another side of said base floor member.

7. The invention of claim 6 further including,
a seat mounting plate assembly positioned on said base floor member;
at least one seat mounted on said plate assembly;
means for manually driving said seat from a single position outside the area defined by and within said side frame members;
a spring biased hammer member relatively movably mounted on one of said side frame members, and
means for releasing the hammer member for relative movement.

8. The invention of claim 6 further including a second platform member attached to said second lower wall member and movable relative thereto.

9. The invention of claim 8 further including a pivotal arm interconnecting said second platform member and said second lower wall member to permit said second platform member to be positioned between said side frame members.

10. A toy space station assembly with movable walls comprising;

a base floor member;

a pair of hexagonal side frame members extending upward from said floor member;

a pair of lower wall members extending between said side frame members and extending upward and outward from respective sides of said base floor member;

a first upper wall assembly, pivotally mounted at an axis through the midpoints of its sides to the side frame members and positioned above a rear lower wall member, having a first platform member connected to and extending from said upper wall assembly, said first platform member being relatively disposed to said upper wall assembly so as to permit the lower surface of said first platform member to extend across the top surface area between the side frame members when the upper wall assembly is rotated about an axis; and a second upper wall platform assembly movably mounted above a front lower wall member for positioning between said hexagonal side frame members.

* * * * *